US008851399B2

(12) United States Patent
Ballu et al.

(10) Patent No.: US 8,851,399 B2
(45) Date of Patent: Oct. 7, 2014

(54) SPRAYING MEMBER, SPRAYING DEVICE COMPRISING SUCH A MEMBER AND SPRAYING INSTALLATION COMPRISING SUCH A DEVICE

(75) Inventors: Patrick Ballu, Reims (FR); Philippe Foury, Crolles (FR); Djamel Merabet, Eybens (FR); Philippe Provenaz, Allinges (FR); Eric Prus, Grenoble (FR)

(73) Assignee: Sames Technologies, Meylan (FR)

( * ) Notice: Subject to any disclaimer, the term of this patent is extended or adjusted under 35 U.S.C. 154(b) by 1267 days.

(21) Appl. No.: 12/597,328

(22) PCT Filed: Apr. 22, 2008

(86) PCT No.: PCT/FR2008/000566

§ 371 (c)(1),
(2), (4) Date: Apr. 5, 2010

(87) PCT Pub. No.: WO2008/145845

PCT Pub. Date: Dec. 4, 2008

(65) Prior Publication Data

US 2010/0193604 A1 Aug. 5, 2010

(30) Foreign Application Priority Data

Apr. 23, 2007 (FR) ..... 07 02928

(51) Int. Cl.

| | |
|---|---|
| ***B05B 3/10*** | (2006.01) |
| ***B44D 5/10*** | (2006.01) |
| ***F23D 11/04*** | (2006.01) |
| ***B05B 3/00*** | (2006.01) |
| ***F23D 11/32*** | (2006.01) |
| ***B05B 5/04*** | (2006.01) |

(52) U.S. Cl.

CPC ..... *B05B 3/1014* (2013.01); *B05B 3/1007* (2013.01); *B05B 3/1071* (2013.01); *B05B 5/0407* (2013.01); *B05B 3/1064* (2013.01)

USPC ..... 239/223; 239/224; 239/700; 239/703

(58) Field of Classification Search

CPC .. B05B 3/1064; B05B 3/1071; B05B 3/1014; B05B 3/1007; B05B 5/0407

USPC ..... 239/223, 224, 699–703, 222.11, 380, 239/301, 383; 110/263–266; 431/184–185, 431/182, 177, 187, 354; 118/321, 323

See application file for complete search history.

(56) References Cited

U.S. PATENT DOCUMENTS

| | | | | | |
|---|---|---|---|---|---|
| 3,504,851 | A | * | 4/1970 | Demeter | 239/703 |
| 5,078,321 | A | * | 1/1992 | Davis et al. | 239/224 |
| 5,474,236 | A | * | 12/1995 | Davis et al. | 239/703 |

(Continued)

FOREIGN PATENT DOCUMENTS

| | | | |
|---|---|---|---|
| FR | 1335550 | * | 7/1962 |
| FR | 1335550 | A | 8/1963 |

(Continued)

*Primary Examiner* — Len Tran
*Assistant Examiner* — Alexander M Valvis
(74) *Attorney, Agent, or Firm* — Browdy and Neimark, PLLC

(57) ABSTRACT

The invention relates to a member (10) for spraying a coating product comprising a primary surface (20) for spreading the product and at least two secondary, inner (21) and outer (22) surfaces for spreading the product that extend downstream of the primary surface (20), the primary (20) and secondary (21, 22) surfaces being coaxial ($X_{10}$-$X_{10}$), the downstream portions of the secondary surfaces (21, 22) defining an inner spraying edge (23) and an outer spraying edge (24). The downstream portions (21*b*, 22*b*) of the secondary surfaces (21, 22) have, relative to one another, directions (A21, A22) that are overall divergent towards the downstream direction. The inner edge (23) has a diameter substantially smaller than the diameter of the outer edge (24).

17 Claims, 4 Drawing Sheets

(56) References Cited

U.S. PATENT DOCUMENTS

| | | | | |
|---|---|---|---|---|
| 5,752,657 | A * | 5/1998 | Hogan et al. | 239/7 |
| 5,788,165 | A * | 8/1998 | Sakakibara et al. | 239/700 |
| 5,816,508 | A * | 10/1998 | Hollstein et al. | 239/700 |
| 6,003,784 | A * | 12/1999 | van der Steur | 239/222.11 |
| 6,050,499 | A * | 4/2000 | Takayama et al. | 239/112 |
| 6,076,751 | A * | 6/2000 | Austin et al. | 239/700 |
| 6,363,952 | B1 | 4/2002 | Baioff et al. | |
| 6,513,729 | B2 * | 2/2003 | Ochiai et al. | 239/223 |
| 6,811,094 | B2 * | 11/2004 | Sonoda et al. | 239/223 |
| 6,988,673 | B2 * | 1/2006 | Kon et al. | 239/223 |
| 7,143,963 | B2 * | 12/2006 | Tani et al. | 239/456 |

FOREIGN PATENT DOCUMENTS

| | | | |
|---|---|---|---|
| GB | 2197600 | A | 5/1988 |
| SU | 733565 | A1 | 5/1980 |

* cited by examiner

SPRAYING MEMBER, SPRAYING DEVICE COMPRISING SUCH A MEMBER AND SPRAYING INSTALLATION COMPRISING SUCH A DEVICE

The present invention relates to a spraying member and a rotary device for spraying coating product comprising such a spraying member, and an installation for spraying coating product comprising such a device.

Conventional spraying by means of rotary devices is used for applying on objects to be coated, such as motor vehicle bodies, a primer, a basecoat and/or a lacquer with a coating product flow rate of between 100 and 500 $cm^3$/min. In order to reduce the costs associated with the installation and operation of the paint lines, the motor vehicle market tends to reduce their length and the number of spraying robots equipping these lines. The paint spraying devices designed to be mounted on these robots must therefore be capable of spraying the coating products with high flow rates.

In the prior art, rotary sprayers fitted with large-diameter spraying members are known which make it possible to spray the coating product in finer droplets and which are therefore capable of spraying the coating products with higher flow rates. However, it is difficult to rotate at very high speed a spraying member with a large radial dimension, because the performance of the existing rotary-drive turbines are becoming insufficient and their air consumption prohibitive. Moreover, the control of the jet of sprayed product is becoming difficult which may degrade the quality of the coating and the efficiency of deposition.

FR-A-1 335 550 proposes, with respect to its FIG. 15, to increase the flow rate of the coating product by using a rotary device fitted with a spraying member comprising several spraying edges. Such a spraying member makes it possible to increase the effective length of spraying while retaining a construction that is relatively compact radially, and therefore easy to rotate. Such a member makes it possible to spray high flow rates of coating product. However, the surfaces of distribution of the product define edges of substantially identical diameter and have, in a plane of symmetry such as that of FIG. 15, parallel and even convergent directions. The jets of product sprayed by these various edges are therefore confluent, so that the droplets that comprise them have a considerable risk of recombining. The spraying member described by FR-A-1 335 550 therefore risks forming droplets of uniform dimensions, which degrades the quality of the coating.

The interferences between the jets of sprayed product are all the more damaging to the quality of the coating as the rotation speed of the spraying member increases. It is true that the speed of rotation, hence the flow rate of product, applied to the spraying member described by FR-A-1 335 550 is not particularly high. Specifically, FIG. 16 of FR-A-1 335 550 shows a spraying member to which metal sheet cups are attached by screws and spaced out by spreaders. Such elements would cause considerable problems of balancing if the spraying member had to rotate at current speeds which can exceed 50 000 rpm under load.

SU-A-733 565 describes a spraying member for a device for spraying liquid product. This spraying member comprises three spraying edges the diameters of which are identical. It therefore has a poor axial compactness and a relatively high risk of recombining the sprayed droplets.

It is these drawbacks that the invention is intended more particularly to remedy by proposing a spraying member comprising at least two divergent surfaces for spraying the product.

Accordingly, the subject of the invention is a spraying member for a device for spraying coating product, said spraying member comprising a primary surface for distributing the product and at least two secondary surfaces, an inner surface and an outer surface, for distributing the product extending downstream of the primary surface, the primary surface and secondary surfaces being coaxial, the downstream portions of the secondary surfaces defining respectively at least one inner spraying edge and at least one outer spraying edge, the downstream portions of the secondary surfaces having, relative to one another, directions that are generally divergent in the downstream direction, characterized in that the inner edge has a diameter substantially smaller than the diameter of the outer edge.

By virtue of the invention, the coating product is first distributed over the primary surface of the spraying member, it is then spread over divergent secondary surfaces downstream of which it is sprayed by the edges of different diameters, thereby forming divergent jets, which prevents the recombination of the droplets. The droplets of sprayed product can therefore have uniform dimensions and thus produce a coating of quality on the object to be coated. Moreover, the spraying member has an axial compactness which makes it easy to handle.

According to advantageous but not obligatory aspects of the invention, such a spraying member may incorporate one or more of the following features:

- the outer edge is axially set back in the upstream direction relative to the inner edge;
- the member also comprises channels for distributing the coating product each extending between an inlet situated on an upstream portion of the inner secondary surface and an outlet situated facing an upstream portion of the outer secondary surface, the inlets and the outlets being placed on a ring coaxial with the edges;
- the member also comprises orifices each extending between an inlet situated on the outer surface of the spraying member and an outlet situated on an upstream portion of the outer secondary surface, the inlets and outlets being placed on a ring coaxial with the edges;
- the channels and the orifices consist of cylindrical drillholes the outlets of which are distributed in an alternating manner on the upstream portion of the outer secondary surface;
- the channels and/or the orifices have different diameters;
- the channels and the orifices are different in number;
- the secondary surfaces are frustoconical;
- the secondary surfaces form between them and in a plane of symmetry of the spraying member an angle of between 16° and 24°, preferably of 20°;
- the outer secondary surface has a length of more than 5 mm, preferably of more than 10 mm;
- the secondary surfaces are warped;
- the member is in one piece, the secondary surfaces and primary surface being defined by one and the same piece;
- the member consists of a body defining the primary surface and one of the secondary surfaces and of a piece secured to the body and defining the other secondary surface.

Moreover, the invention relates to a rotary device for spraying coating product comprising a spraying member, means for rotating this member and means for supplying this member with coating product, this spraying member being as explained above.

Moreover, the invention relates to an installation for spraying coating product comprising at least one rotary device for spraying coating product as explained above.

The invention will be well understood and other advantages of the latter will clearly appear in the light of the following description, given only as an example and made with reference to the appended drawings in which.

Figure 1:
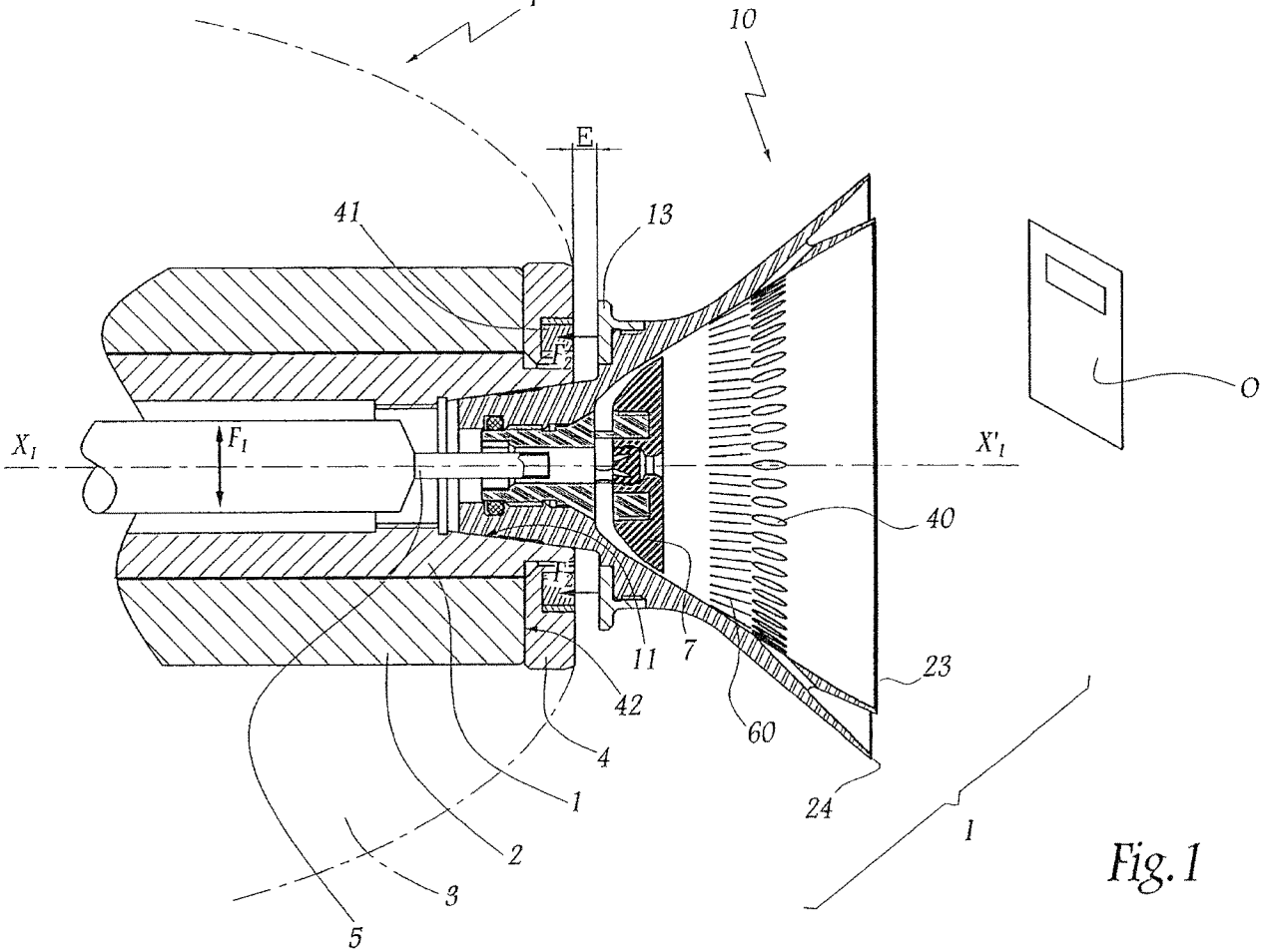
FIG. 1 is a longitudinal sectional diagram of a sprayer of coating product according to the invention used in an installation according to the invention and incorporating a spraying member according to the invention.

The sprayer P shown in FIG. 1 is supplied with coating product from one or more sources not shown and moved, for example with an essentially vertical movement represented by the double arrow $F_1$, facing object O to be coated within an installation I for coating these objects. The sprayer P comprises an air turbine the rotor 1 of which can be seen in FIG. 1, this rotor 1 being rotated about an axis $X_1$-$X'_1$.

A body 2, fixed relative to the axis $X_1$-$X'_1$, surrounds the rotor 1 and is itself isolated from the outside by a cover 3. An annular support 4 made of magnetic material, for example of magnetic stainless steel, is mounted on the front face 42 of the body 2, this support 4 being provided with an annular groove centered on the axis $X_1$-$X'_1$ and in which annular groove an annular magnet 41 is placed. An injector 5 of coating product is housed in the center of the body 2, coaxially with the axis $X_1$-$X'_1$.

The spraying member 10 is mounted on the sprayer P and its upstream portion forms a male frustoconical surface designed to interact with a female frustoconical surface 11 of the rotor 1 in order to fasten the spraying member 10 in rotation with the rotor 1. In order to ensure an effective bearing of the surfaces 12 and 11 against one another and a rotary immobilization in the manner of a Morse cone, a ferrule 13 made of ferromagnetic material is mounted on the spraying member 10, so that an attraction force $F_2$ due to the magnet 41 is exerted on the ferrule 13. The surfaces 11 and 12 are therefore firmly flattened one against the other, while an air gap E is arranged between the ferrule 13 and the support 4. Application in this instance is made of the technical teaching of FR-A-2 887 472.

The spraying member 10 has the shape of a cup with two spraying edges. Its mid-portion forms a primary surface for distributing the coating product originating from the injector 5 via a distributor 7 extending opposite to the upstream portion 25 of the primary surface 20. The terms upstream and downstream make reference to the direction of flow of the product from the injector 5 to the object O to be coated.

Downstream of the primary surface 20, two secondary surfaces 21 and 22 extend for distributing the coating product. The secondary surface 21 is called inner, because it is situated closer to the central axis $X_{10}$-$X'_{10}$ of the member 10, while the secondary surface 22 is called outer, because it is further away from it. The downstream portions of each of the secondary surfaces 21 and 22 define respectively an inner edge 23 and an outer edge 24, on which the coating product is sprayed when the member 10 is rotated. In this instance, the edges 23 and 24 are formed by the respective downstream ends of the secondary surfaces 21 and 22.

The primary surface 20 and secondary surfaces 21 and 22 of the member 10 all have a symmetry of revolution about the axis $X_{10}$-$X'_{10}$ which is indistinguishable from the axis $X_1$-$X'_1$, when the member 10 is mounted on the rotor 1. These surfaces are therefore coaxial and the edges 23 and 24 are in the form of circle the centers of which belong to the axis $X_{10}$-$X'_{10}$. In practice, the edges 23 and 24 may have small reliefs or "notches", in order to better spray the coating product.

The primary surface 20 and secondary surfaces 21 and 22 each have the shape of a truncated cone with a circular base and with an axis $X_{10}$-$X'_{10}$. In the radial plane of FIG. 2, the profile of the primary surface 20 forms an angle $A_{20}$ of approximately 32° with the axis $X_{10}$-$X'_{10}$. In the radial plane of FIG. 2, the profile of the inner secondary surface 21 forms an angle $A_{21}$ of approximately 27° with the axis $X_{10}$-$X'_{10}$, while the profile of the outer secondary surface 22 forms an angle $A_{22}$ of approximately 45° with the axis $X_{10}$-$X'_{10}$. Therefore, the secondary surfaces 21 and 22, and more particularly their respective downstream portions 21*b* and 22*b*, are inclined relative to one another at an angle $A_{22}$-$A_{21}$ of 20° and they have divergent directions in the downstream direction, that is to say toward their edges 23 and 24. In practice, satisfactory results may be obtained when the secondary surfaces 21 and 22 form, between them and in a plane of symmetry of the member 10, an angle of between 16° and 24°.

Because of their different inclinations and their respective lengths, the secondary surfaces 21 and 22 define circular edges 23 and 24 having diameters $D_{23}$ and $D_{24}$ that are substantially different. For example, the diameter $D_{23}$ may be 54 mm, while the diameter $D_{24}$ may be approximately 64 mm. Thus, the diameter $D_{23}$ of the inner edge 23 is substantially smaller than the diameter $D_{24}$ of the outer edge 24. The divergence of the surfaces 21 and 22 makes it possible to prevent as much as possible the jets of product sprayed respectively by the inner edge 23 and outer edge 24 from recombining. The term "recombined" in this instance means the mixture of the jets with one another, which poses both a problem of aeraulic disruptions and a problem of confluence of the droplets.

The construction of the member 10 according to the invention therefore makes it possible to prevent or to limit the recombination of the jets, which would result in particular in the increase of the size of the droplets of product. Therefore, it is possible to obtain an even spray having droplets that are fine and of uniform size. In addition, the difference between the diameters $D_{23}$ and $D_{24}$ makes it possible to ensure a good separation of the jets of sprayed product without axially lengthening the member 10 too much. This axial compactness of the member 10 allows for example a multiaxis robot to easily manipulate a rotary sprayer which is fitted therewith around and in the objects O to be coated.

Figure 3:
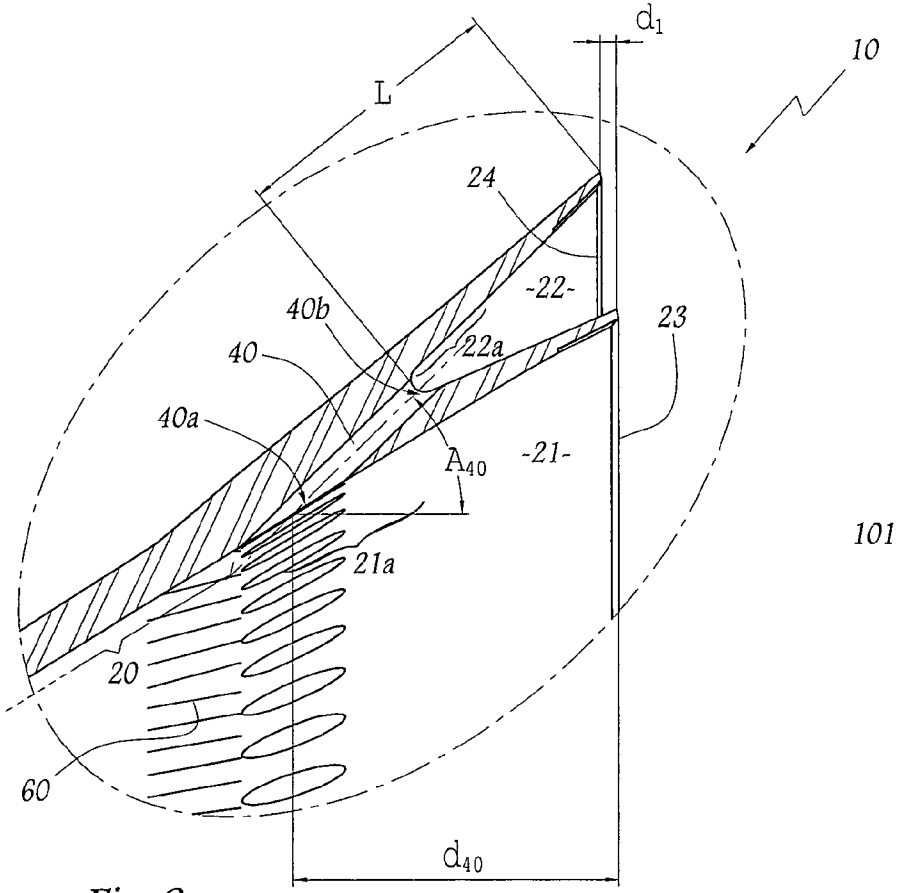
FIG. 3 is a partial section showing the detail III of FIG. 2.

The edges 23 and 24 are not in the same plane, but offset axially from one another, the outer edge 24 being set back at a non-zero distance $d_1$ in the upstream direction relative to the inner edge 23. For example, the distance $d_1$ by which the edge 24 is set back from the edge 23, as can be seen in FIG. 3, may be 1 mm. Preferably, the distance $d_1$ is greater than 1% of the diameter $D_{23}$ of the inner edge 23. The greater the distance $d_1$, the less the jets of sprayed product risk recombining.

Figure 2:
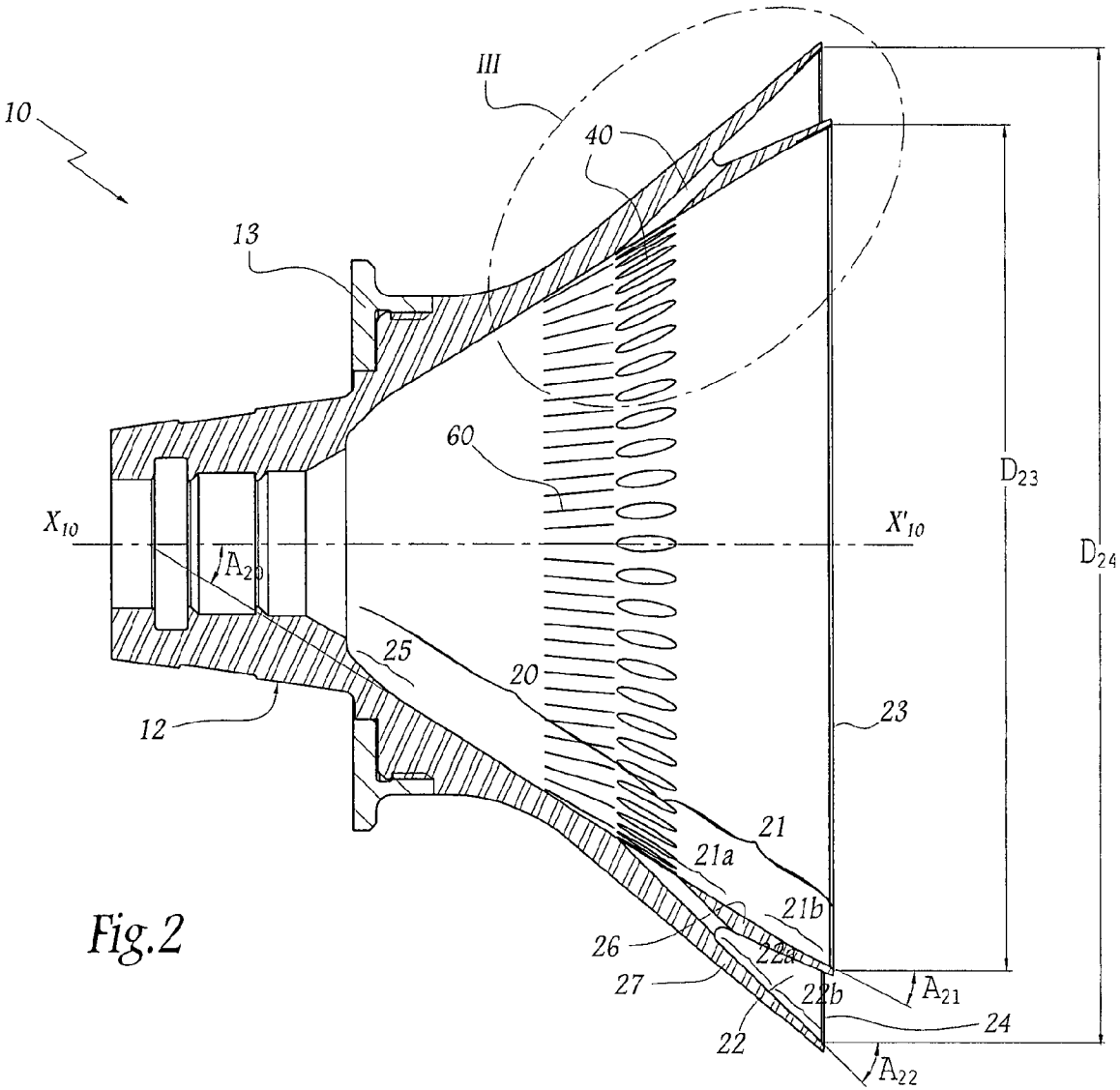
FIG. 2 is an axial section on a larger scale of the spraying member of FIG. 1.
Figure 4:
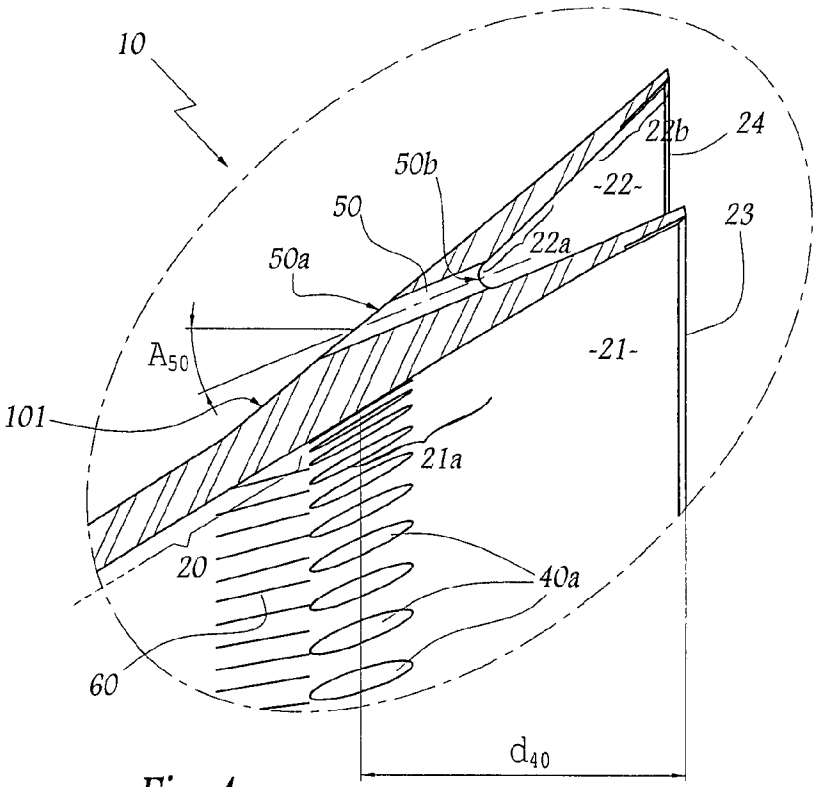
FIG. 4 is a partial section of the spraying member of FIG. 2 according to a plane offset angularly relative to the sectional plane of FIG. 2.

In the embodiment illustrated by FIGS. 2 to 4, the secondary surfaces 21 and 22 are made in the same piece as the primary surface 20. The member 10 is therefore made in a single piece, which makes it possible to obtain a good balance in rotation, because it is machined with precision.

The member 10 also comprises channels 40, for distributing the coating product, which each extend between an inlet 40*a* situated on an upstream portion 21*a* of the inner secondary surface 21 and an outlet 40*b* situated opposite to an upstream portion 22*a* of the outer secondary surface 22. Specifically, the inlet 40*a* of a channel 40 is at the join of the downstream portion of the primary surface 20 and the upstream portion 21*a* of the inner secondary surface 21.

The inlets 40*a* of all the channels 40 are placed on a ring that is frustoconically shaped and coaxial with the secondary surface 21 and therefore with its edge 23. Similarly, the outlets 40*b* are placed on a ring that is frustoconically shaped and coaxial with the secondary surface 22 and hence with its edge 24.

The channels 40 consist of cylindrical drillholes made in a wing 26 of the member 10 forming the inner secondary surface 21. The channels 40 have for example a diameter of 1 mm and extend in an oblique direction forming an angle $A_{40}$ with the axis $X_{10}$-$X'_{10}$ in a radial plane, that is to say in a plane of symmetry of the member 10. In the plane of FIG. 3, the angle $A_{40}$ is approximately 45°. The centers of the inlets 40*a* are situated at a distance $d_{40}$ from the edge 23, said distance being for example 10 mm.

The function of the channels 40 is to distribute the coating product originating from the primary surface 20 to the outer secondary surface 22. To achieve a uniform distribution, the channels 40 are distributed evenly about the axis $X_{10}$-$X'_{10}$. The fraction of coating product that does not flow in the channels 40 passes between these channels and reaches the inner secondary surface 21. The distribution of the coating product between the secondary surfaces 21 and 22 therefore occurs at the join between the primary surface 20 and the secondary surface 21, that is to say on the upstream portion 21*a* of the latter. The position and orientation of the channels 40 are determined by the passage of the drilling tool between the wings 26 and 27. The channels are drilled so that as much as possible they run tangential to the outer secondary surface 22, which makes this surface easier to clean and reduces its wear by the coating product.

As shown in FIG. 4, the member 10 also comprises orifices 50 which each extend between an inlet 50*a* situated on the outer surface 101 of the member 10 and an outlet 50*b* situated on an upstream portion 22*a* of the outer secondary surface 22. The orifices 50 are made by a cylindrical drilling operation carried out in a wing 27 which defines the secondary surface 22. Each orifice 50 is in this instance rectilinear and extends on an axis contained in a radial plane. It has a diameter equivalent to the diameter of the channels 40, for example 1 mm, and their inlet 50*a* or their outlet 50*b* are placed on a ring coaxial with the edges 23 and 24. In the plane of FIG. 4, the orifices 50 are oblique and form an angle $A_{50}$ of approximately 25° with the axis $X_{10}$-$X'_{10}$. Alternatively, it is possible to provide channels 40 and/or orifices 50 having different diameters.

Because of their inclination, the orifices 50 induce an air flow on the outer side of the wing 26 forming the inner secondary surface 21, when the member 10 is rotating. Such an air flow makes it possible to fill the pressure drop created between the edges 24 and 23 and thus prevent droplets sprayed by the inner edge 23 from returning to the volume situated between the wings 26 and 27. Moreover, this air flow makes it possible to create a skirt of induced air surrounding the jet sprayed by the inner edge 23, which prevents the latter from recombining with the jet sprayed by the edge 24. Like the channels 40, the orifices 50 are distributed evenly about the axis $X_{10}$-$X'_{10}$. They therefore emerge at the upstream portion of the outer secondary surface 22 so as to alternate with the channels 40. In other words, the orifices 50 and the channels 40 are the same in number and they are placed alternately. It is however possible to provide channels 40 and orifices 50 in different numbers and/or with a less even distribution.

During spraying, the member 10 rotates about its axis $X_{10}$-$X'_{10}$ at very high speed, typically between 30 000 and 70 000 rpm. The coating product, such as a liquid paint, is brought by the injector 5 and splashes against the upstream face of the distributor 7, before being distributed and spread over the primary surface 20. Downstream of the primary surface 20, the paint is distributed and spread over the inner secondary surface until it reaches the spraying edge 23 where it divides into fine droplets.

Under the effect of the centrifugal forces, a fraction of the paint originating from the primary surface 20 passes through the channels 40 and is then distributed and spread over the outer secondary surface 22 until it reaches the spraying edge 24 where it is divided into fine droplets. To allow the film of paint to spread appropriately over the outer secondary surface 22 after coming out of the channels 40, it is desirable to provide a secondary surface 22 having a sufficient length L. In practice, the length L must be greater than 5 mm and preferably than 10 mm.

For a given diameter of channel 40 and for a given number of channels 40, the distribution of the paint between the inner edge 23 and outer edge 24 depends on the flow rate of product and the speed of rotation of the member 10. These parameters may be chosen in order to carry out a distribution of approximately 50% for each of the edges. It is also possible to distribute the paint at 30% for the inner edge 23 and 70% for the outer edge 24, depending on the operating parameters adopted to suit the desired application.

Moreover, a notched annular zone 60 may be arranged on the primary surface 20 so as to set in motion all the layers of the paint film which is spread thereon at the same tangential speed as the channels 40. This makes it possible to promote the passage of the paint in the channels 40 and to ensure that the flow rate remains constant over each edge 23 and 24 for a given rotation speed of the member 10. In practice, the notches of the zone 60 may be 2.5 mm long, 0.15 mm deep and spaced at a pitch of 0.3 mm. It is also possible to envisage extending the notches in each channel 40 so as to amplify their influence over the flow of the paint.

Figure 5:
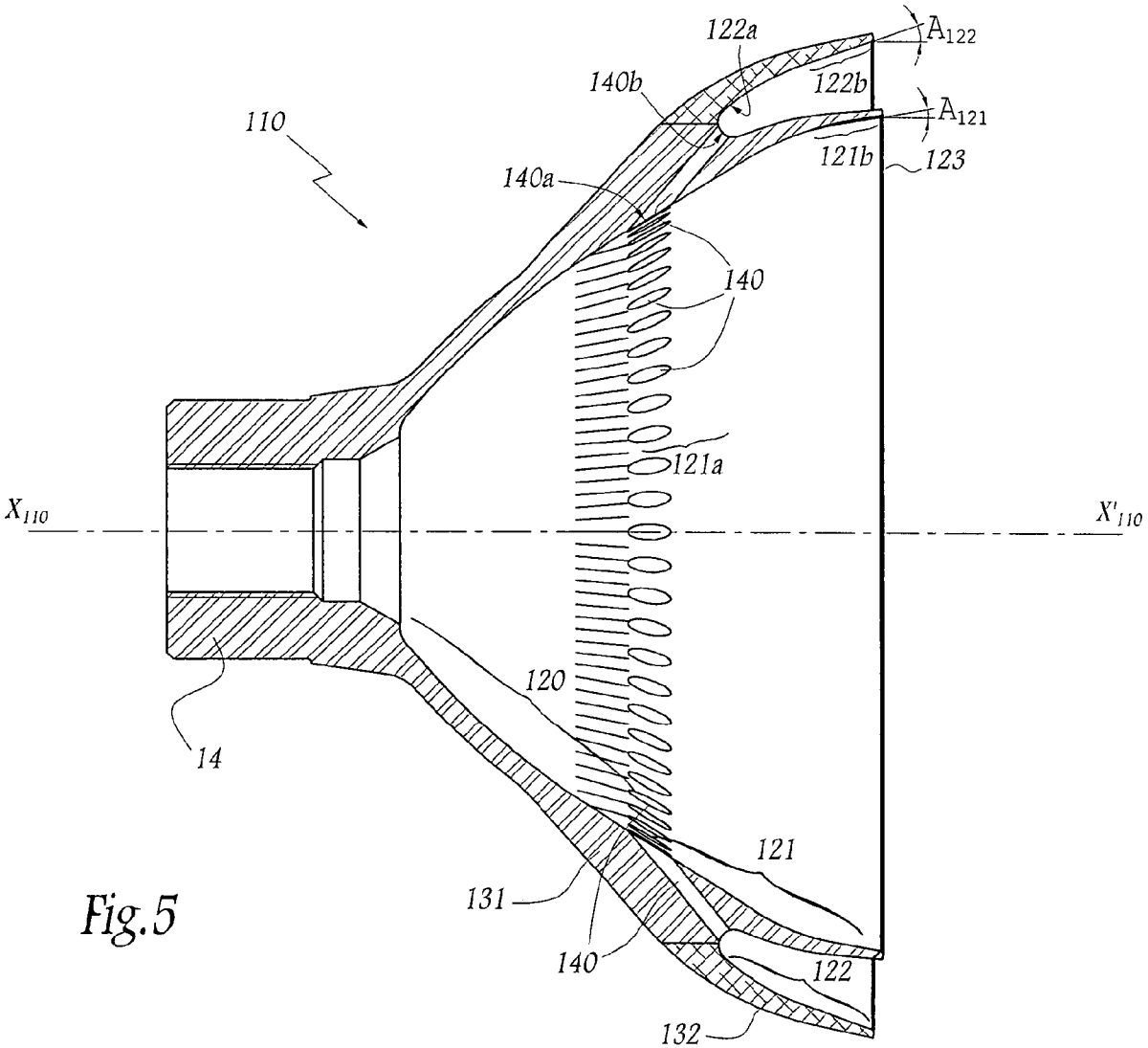
FIG. 5 is an axial section of a spraying member according to a second embodiment of the invention.

FIG. 5 illustrates a second embodiment of a spraying member according to the invention. Similar elements bear the same reference numbers as in the previous figures, increased by 100. The member 110 illustrated by FIG. 5 differs from the member 10 in its structure and in the shape of its primary and secondary surfaces. The inner secondary surface 121 and outer secondary surface 122 are in this instance warped surfaces resembling paraboloids of revolution about an axis $X_{110}$-$X'_{110}$. Similarly the primary surface 120 has a shape similar to a paraboloid of revolution. "Warped surface" means a surface that is not straight, that is to say a surface with a curved or a concave profile relative to the cup 131.

As in the case of the member 10, the downstream portions 121*b* and 122*b* of the secondary surfaces 121 and 122 respectively form, relative to the central axis $X_{110}$-$X'_{110}$ average angles $A_{121}$ and $A_{122}$ which define directions that are generally divergent in the downstream direction, that is to say toward the object O to be coated. In a radial plane, the average angle of a downstream portion the profile of which is not rectilinear may be evaluated as the average of the angles formed by the tangents at each point of this profile with the central axis. In practice, it is sufficient to average the angles formed by a few tangents, for example four, distributed evenly along the profile of the downstream portion. In this instance, the directions defined by the angles $A_{121}$ and $A_{122}$ of the downstream portions 121*b* and 122*b* of the secondary surfaces 121 and 122 are divergent and they form between them an angle of approximately 10°. As in the first embodiment, this makes it possible to prevent the recombination of the jets sprayed by the inner edge 123 and outer edge 124.

Because of the geometry of the secondary surfaces 121 and 122, it would be awkward to pass a drilling tool between the edges 123 and 124 in order to produce the channels 140 designed to distribute the coating product. This is why the member 110 in this instance consists of a main cup 131 in which the channels 140 are drilled prior to the attachment, for example by shrink-fitting, of a ring 132 designed to form the outer secondary surface 122. Orifices similar to the orifices 50 may be made by drilling in the member 110 in order to fulfill similar functions.

Other embodiments are possible without departing from the context of this invention. It is possible, for example, to provide three or more secondary surfaces for distributing the product, distribution channels having different diameters and/or placed on several coaxial rings with zigzagged inlets.

Moreover, the invention has been shown in FIGS. 1 and 2 with a spraying member attached to the rotor by magnetic effect. However, the spraying member may be attached by any other means and it may notably be screwed by means of a thread 14 capable of interacting with a matching tapping made in the rotor 1, as shown in FIG. 5 for the member 110.

The invention claimed is:

1. A rotary spraying member for a device for spraying coating product, said spraying member being mounted for rotation when the device is spraying coating product, said rotary spraying member comprising a primary surface for distributing the coating product and an outer secondary surface for distributing the coating product from the primary surface, extending downstream of the primary surface, said rotary spraying member further having a product distributing portion that rotates with said rotary spraying member when said rotary spraying member is in use, said product distributing portion providing an inner secondary surface extending downstream of the primary surface, and said spraying member having coating product passages disposed to conduct coating product from the primary surface to the outer secondary surface, the primary surface and secondary surfaces being coaxial and rotating with said product distribution surface when said product distribution surface rotates, the secondary surfaces having downstream portions defining respectively at least one inner spraying edge and at least one outer spraying edge, the at least one inner spraying edge being radially spaced from the at least one outer spraying edge, and the downstream portions of the secondary surfaces having, relative to one another, directions such that the product distributed from said outer secondary surface diverges from the product distributed from said inner secondary surface in the downstream direction, and wherein the inner spraying edge has a diameter substantially smaller than the diameter of the outer spraying edge.

2. The rotary spraying member as claimed in claim 1, wherein the outer edge is axially set back in the upstream direction relative to the inner edge.

3. The rotary s spraying member as claimed in claim 1, wherein it also comprises channels for distributing the coating product each extending between an inlet situated on an upstream portion of the inner secondary surface and an outlet facing an upstream portion of the outer secondary surface, the inlets and the outlets being placed on a ring coaxial with the edges.

4. The rotary spraying member as claimed in claim 1, wherein it also comprises a plurality of orifices each extending between an inlet situated on the outer surface of the spraying member and an outlet situated on an upstream portion of the outer secondary surface, the inlets and outlets being placed on a ring coaxial with the edges.

5. The rotary spraying member as claimed in claim 3, wherein the channels and the plurality of orifices consist of cylindrical drillholes the outlets of which are distributed in an alternating manner on the upstream portion of the outer secondary surface.

6. The rotary spraying member as claimed in claim 4, wherein the channels and/or the plurality of orifices have different diameters.

7. The rotary spraying member as claimed in claim 4, wherein there is a first number of channels and a second number of orifices, the first number being different from the second number.

8. The rotary spraying member as claimed in claim 1, wherein the secondary surfaces are frustoconical.

9. The rotary spraying member as claimed in claim 8, wherein the secondary surfaces form between them and in a plane of symmetry of the spraying member an angle of between 16° and 24°.

10. The rotary spraying member as claimed in claim 8, wherein the outer secondary surface has a length of more than 5 mm, preferably of more than 10 mm.

11. The rotary spraying member as claimed in claim 1, wherein the secondary surfaces are warped.

12. The rotary spraying member as claimed in claim 1, wherein it is in one piece, the secondary surfaces and primary surface being defined by one and the same piece.

13. The rotary spraying member as claimed in claim 1, wherein it consists of a body defining the primary surface and one of the secondary surfaces and of a piece secured to the body and defining the other secondary surface.

14. A rotary device for spraying coating product comprising a spraying member, means for rotating said member and means for supplying said member with coating product, wherein said spraying member is as claimed in claim 1.

15. An installation for spraying coating product, wherein it comprises at least one rotary device for spraying coating product as claimed in claim 14.

16. The rotary spraying member as claimed in claim 9, wherein the angle formed between the secondary surfaces is 20°.

17. A rotary spraying member for a device for spraying coating product, said spraying member being mounted for rotation when the device is spraying coating product, said rotary spraying member comprising a primary surface for distributing the coating product and an outer secondary surface for distributing the coating product from the primary surface, extending downstream of the primary surface, said spraying member further having a product distributing portion that rotates with said rotary spraying member when said rotary spraying member is in use, said product distributing portion providing an inner secondary surface extending downstream of the primary surface, and said spraying member having coating product passages disposed to conduct coating product from the primary surface to the outer secondary surface, the primary surface and secondary surfaces being coaxial and rotating with said product distribution surface when said product distribution surface rotates, the inner secondary surface having a downstream portion having a downstream end forming an inner spraying edge from which coating product is sprayed and the outer secondary surface having a downstream portion having a downstream end forming an outer spraying edge from which coating product is sprayed, the at least one inner spraying edge being radially spaced from the at least one outer spraying edge, and the inner secondary surface having a direction that is divergent in the downstream direction from the outer secondary surface, such that the product distributed from the inner spraying edge diverges from the product distributed from the outer spraying edge, and wherein the inner spraying edge has a diameter smaller than the diameter of the outer spraying edge.

* * * * *